United States Patent [19]

Tanikawa

[11] Patent Number: 4,715,152

[45] Date of Patent: Dec. 29, 1987

[54] WATERTIGHT WINDOWSILL CONSTRUCTION

[75] Inventor: Shinji Tanikawa, Namerikawa, Japan

[73] Assignee: Yoshida Kogyo K. K., Tokyo, Japan

[21] Appl. No.: 946,523

[22] Filed: Dec. 24, 1986

[30] Foreign Application Priority Data

Dec. 25, 1985 [JP] Japan ..... 60-198440

[51] Int. Cl.[4] ..... E06B 7/14

[52] U.S. Cl. ..... 52/209; 49/408; 52/97; 52/303

[58] Field of Search ..... 52/97, 209, 303; 49/408, 471

[56] References Cited

U.S. PATENT DOCUMENTS

| | | | |
|---|---|---|---|
| 3,221,453 | 12/1965 | Lietaert | 52/209 |
| 3,383,815 | 5/1968 | Smith, Jr. | 52/209 |
| 3,636,660 | 1/1972 | Peterson | 49/408 |
| 3,858,375 | 1/1975 | Silvernail | 52/209 X |
| 3,866,369 | 2/1975 | Paull | 52/209 |
| 4,050,201 | 9/1977 | Hubbard et al. | 52/209 X |
| 4,464,874 | 8/1984 | Shea, Jr. et al. | 52/398 |

FOREIGN PATENT DOCUMENTS

| | | | |
|---|---|---|---|
| 800333 | 10/1950 | Fed. Rep. of Germany | 52/209 |
| 969749 | 7/1958 | Fed. Rep. of Germany | 52/209 |
| 2206420 | 8/1973 | Fed. Rep. of Germany | 52/303 |
| 186141 | 11/1936 | Switzerland | 52/209 |
| 339366 | 8/1959 | Switzerland | 52/209 |
| 478326 | 10/1969 | Switzerland | 52/209 |
| 2105770 | 3/1983 | United Kingdom | 49/408 |
| 2109846 | 6/1983 | United Kingdom | 49/408 |

*Primary Examiner*—Alfred C. Perham

*Attorney, Agent, or Firm*—Hill, Van Santen, Steadman & Simpson

[57] ABSTRACT

A fixed sash window assembly has a generally rectangular frame holding a pane or panel of glass or other material and installed in an opening in an enclosing wall of a building. The frame includes a sill of extruded metal or rigid plastic material interally comprising a substantially horizontal web having legs depending therefrom to be mounted directly on a window base on the foundation of the building, and exterior and interior flanges extending upwardly from the exterior and interior ends of the web. The exterior flange has its top end portion held against the panel via an exterior sealing strip. A series of drain holes are formed in the web, just interiorly of the exterior flange, for draining the water that may flow through the exterior sealing strip. One of the depending legs of the web, disposed most exteriorly, has a horizontal ledge extending exteriorly therefrom beyond the window base into underlying relation to the drain holes in the web. A wet sealing compound can thus be filled in between the horizontal ledge of the exterior leg and the foundation of the building without the possibility of clogging up the drain holes. The drain holes are further protected against the backflow of water up therethrough by a drain shield depending from the exterior end of the web.

5 Claims, 5 Drawing Figures

WATERTIGHT WINDOWSILL CONSTRUCTION

BACKGROUND OF THE INVENTION

This invention relates generally to window and similar panel assemblies for installation in openings in the walls of buildings, and more specifically to an improved watertight windowsill construction suitable for use with fixed sash windows or the like having frame means made from extrusions of metal or rigid plastic material.

A fixed sash window is usually mounted in place by having its sill placed on a window base on a foundation of a building. The window base, which may be of wood, metal, lightweight concrete or like material, has holes formed vertically therethrough for receiving the anchor bolts that have been embedded in, and erected on, the building foundation. Nuts are tightened on the threaded ends of the anchor bolts protruding from the holes in the window base, in order to secure the window base to the foundation. The sill, which usually is an extrusion of metal (e.g. aluminum or its alloys) or rigid plastics (e.g. polyvinyl chloride), is screwed or otherwise fastened to the window base. Following the installation of the sill on the widow base, the spaces between the foundation and the bottom of the sill are caulked by filling in a wet type sealing compound by way of waterproofing.

The sill of a fixed sash window has an upstanding exterior flange which is held against the bottom periphery of a panel or pane of glass or like material via a fluidtight sealing strip. As rainwater will nevertheless intrude through the gap between the sealing strip and the window panel, the sill has formed in its bottom a series of drain holes along its exterior edge for draining the incoming water. U.S. Pat. No. 4,464,874 discloses such a windowsill having a series of drain holes.

As heretofore constructed, however, the windowsill has had no means for shielding the drain holes against the backflow of rainwater up through the holes toward the interior of the window. The rain that has struck the window panel will flow down the same and, futher running down the exterior flange of the sill, may reach the underside of the sill. If then the wind is strong, the rainwater has been easy to be blown up through the drain holes into the inside of the sill.

The drain holes in the sill have given rise to another problem in watertightly caulking the space that is created between the foundation and the bottom of the sill by the interposition of the window base therebetween and which extends along the row of drain holes. Having so far been exposed directly to the space to be caulked, the drain holes have been prone to be clogged up with the waterproofing compound. The caulking operation itself has tended to be very troublesome and time consuming since care has had to be taken so as not to block the drain holes.

SUMMARY OF THE INVENTION

The present invention seeks to effectively waterproof the sill of a fixed sash window or the like without the difficulties encountered heretofore.

More specifically, the invention seeks to provide an improved watertight windowsill construction whereby the drain holes in the sill are effectively shielded against the backflow of water therethrough and are further protected against clogging as the space between the sill and the building foundation is caulked for waterproofing.

Briefly, the improved watertight windowsill construction of this invention may be summarized as comprising a web integrally including a web, an exterior flange, a drain shield and leg means. Generally disposed horizontally, the web has defined therein a series of drain holes disposed along the exterior flange extending upwardly from the exterior end of the web. The drain shield extends downwardly from the web and is disposed just exteriorly of the drain holes. Also depending from the web, the leg means are adapted to be mounted directly on a window base which in turn is mounted fast on a building foundation. The leg means include an exterior leg having a horizontal ledge protruding exteriorly beyond the window base into underlying relation to the drain holes in the web.

Thus, according to the improved windowsill construction of this invention, a desired caulking compound can be filled in a space created between the horizontal ledge of the leg means and the building foundation, instead of in the space between the web of the sill and the building foundation as in the prior art. The horizontal ledge underlies the drain holes in the web at a distance therefrom and so serves to protect the drain holes against the possibility of clogging up with the caulking substance. Accordingly, the space between the ledge and the foundation can be caulked throughout its length without respect to the locations of the drain holes, so that the caulking operation can be effected much more efficiently than heretofore. Unlike the prior art, moreover,the caulking line need not be interrupted at the drain holes for drainage, unlike the prior art, but can be continuous throughout the horizontal dimension of the window. Such a continuous caulking line is more favorable from an aesthetic point of view, too, than that having interruptions at the drain holes.

Another feature of the invention resides in the drain shield depending from the web of the sill, preferably in coplanar relation to the exterior flange. In an embodiment of the invention disclosed herein, in which the improved windowsill construction is adapted for use in a fixed sash window, the exterior flange has its top end held against the lower periphery of a pane or panel of glass or like material via a sealing strip. The rain that has struck the panel will therefore flow down the exterior flange onto the drain shield, thereby to be drained exteriorly of the window. There will practically be no likelihood of the rain flowing interiorly of the drain shield and then up into the drain holes toward the interior of the sill, no matter how heavy the rain may be, and how strong the wind may be.

According to an additional feature of the invention, a water chamber is defined interiorly of the exterior flange and just over the drain holes for receiving the water that may find its way down through a gap, if any, between the panel and the exterior sealing strip. This water chamber is filled with a mass of absorbent material whereby the intruding water is absorbed more readily than it will flow elsewhere. After thoroughly soaking the absorbent material, the water will be positively drained through the drain holes in the bottom of the water chamber.

The above and other features and advantages of our invention and the manner of realizing them will become more apparent, and the invention itself will best be understood, from a study of the following description and appended claims, with reference had to be attached drawings showing the preferred embodiment of the invention.

DESCRIPTION OF THE PREFERRED EMBODIMENT

Figure 1:
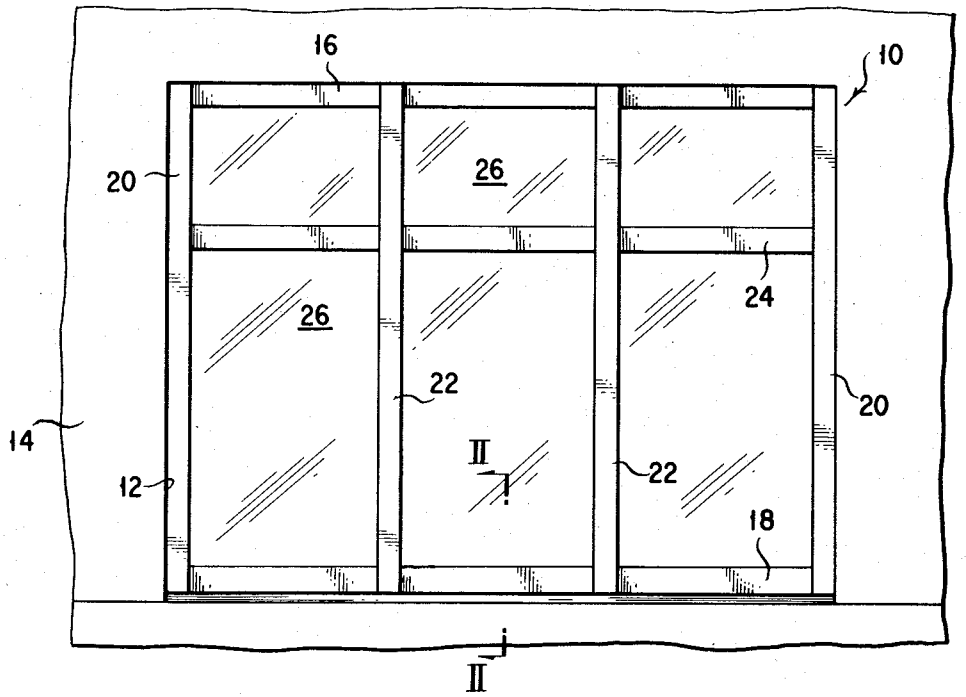
FIG. 1 is an elevation of a fixed sash window assembly incorporating the improved waterproof sill construction of this invention, the window assembly being shown mounted in an opening in an enclosing wall of a building.

The improved watertight windowsill construction of this invention will now be described more specifically as adapted for the fixed sash window assembly shown in FIG. 1. Generally designated 10, the fixed sash window assembly is herein shown installed in an opening 12 in an enclosing wall 14 of a building. The window assembly 10 includes generally framework of generally rectangular arrangement comprising a header 16 and a sill 18 at the top and bottom and a pair of side jambs 20. The window assembly 10 is further shown to comprise two mullions 22 extending vertically between header 16 and sill 18, and a transom 24 extending horizontally between the pair of side jambs 20.

All the noted framing members 16, 18, 20, 22 and 24 can be formed by extrusions of metal, such as aluminum alloy, or rigid thermoplastic synthetic resins such as polyvinyl chloride. Cut into required lengths, such extrusions may be combined and fastened together by suitable fasteners such as screws of stainless steel or like nonrusting metal material.

The window assembly 10 further includes paneling 26 fitted in the spaces bounded by the framing members 16, 18, 20, 22 and 24. As will be seen from FIG. 2, the paneling 26 is herein shown as a pair of panels or panes 28 and 30 of suitable material, preferably polished glass or wired glass, which are spaced from each other as by spacers 31 in the exterior to interior depth direction of the window assembly 10.

Figure 2:
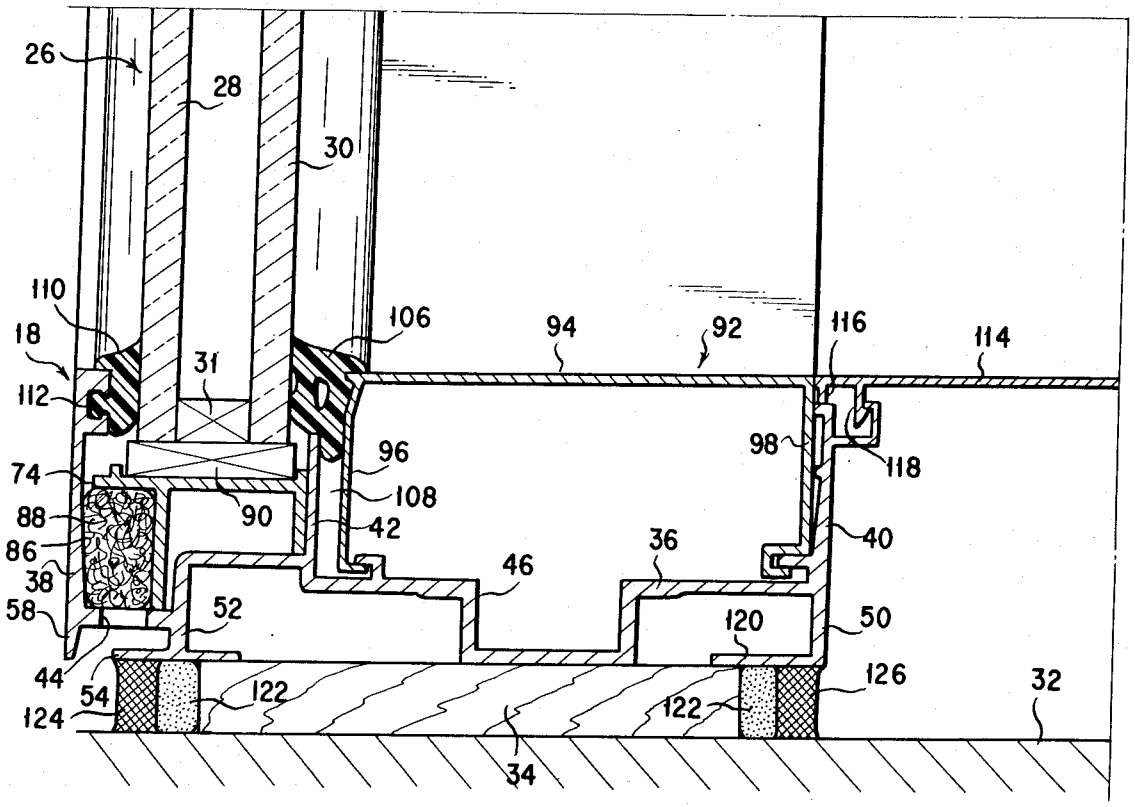
FIG. 2 is an enlarged, fragmentary vertical section through the window assembly of FIG. 1, taken along the line II—II therein and showing in particular the sill and neighboring parts of the window assembly, as well as the building foundation on which the window assembly is mounted.

As illustrated cross sectionally and on an enlarged scale in FIG. 2, the sill 18 of the window assembly 10 is mounted on a building foundation 32 via a suitable supporting structure or structures such as a window base 34. The sill 18 is secured to the window base 34 as by screws, not shown, of stainless steel or like nonrusting metal material.

Figure 3:
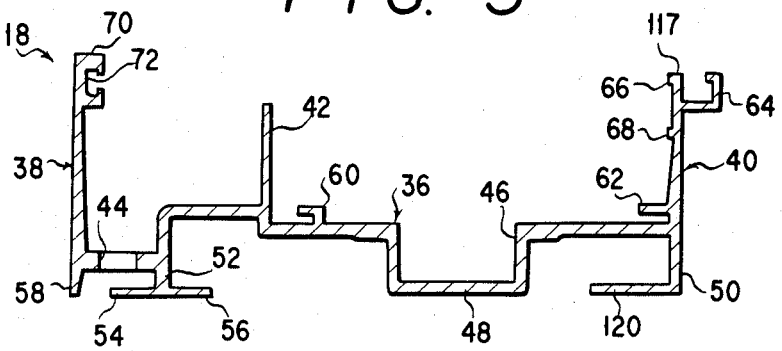
FIG. 3 is a cross sectional view showing only the sill of the window assembly.

Although the sill 18 appears fully in FIG. 2, its configuration will be better understood from an inspection of FIG. 3 which shows only the sill. It should be understood that all the constituent members of the sill 18 to be set forth in its following detailed description are integrally joined together, the sill being an extrusion of metal or rigid plastic material. Broadly, the sill 18 comprises a web 36 to be placed generally horizontally on the window base 34, an exterior flange 38 extending upwardly from the exterior end (shown directed to the left in FIGS. 2 and 3) of the web 36, and an exterior flange 40 extending upwardly from the interior end of the web 36. An intermediate flange 42 is further erected on the web 36 in a position intermediate the exterior and interior flanges 38 and 40 but closer to the exterior flange.

A series of drain holes 44, one seen, are formed at suitable spacings in the web 36 just interiorly of, and along, the exterior flange 38. Any water that may find its way into the sill 18 is to be drained to the exterior of the window assembly 10 through these drain holes 44, as will be later explained in more detail.

The web 36 has a depression 46, located intermediate its exterior and interior ends, to provide a surface 48 resting directly on the window base 34. Further, and L shaped leg 50 depends from the interior end of the web 36, also for resting directly on the window base 34. Another leg 52 is formed on the underside of the web 36 in a position just interiorly of the drain holes 44 and midway between the exterior flange 38 and intermediate flange 42. This exterior leg 52 has a first horizontal ledge 54 extending exteriorly from its bottom end into spaced underlying relation to the drain holes 44 for protecting the same from being clogged by a sealing compound in accordance with a feature of this invention. A second horizontal ledge 56 extends interiorly from the bottom end of the exterior leg 52 to rest directly on the window base 34. The exterior leg 52 with its horizontal ledges 54 and 56 is therefore generally in the shape of an inverted T.

It will have been seen that the sill 18 is mounted on the window base 34 by having its depressed surface 48 and interior and exterior legs 50 and 52 bears against the window base. However, the provision of the interiorly extending ledge 56 of the exterior leg 52 is not essential; instead, the exterior leg may be provided only with the exteriorly extending ledge 54 and so generally may be L shaped like the interior leg 50. In that case the ledge 54 must be adapted to serve the dual purpose of bearing against the window base 34 and protecting the drain holes 44 against clogging up with the sealing compound.

At 58 is seen a drain shield depending from the web 36 and lying just exteriorly of the drain holes 44. Preferably disposed in coplanar relation to the exterior flange 38, the drain shield 58 functions to shield the drain holes 44 against the backflow of water up therethrough into the inside of the sill 18 in accordance with the invention.

The sill 18 is further formed to include the following parts: (a) a hook 60 formed on the top surface of the web 36 and disposed interiorly of the intermediate flange 42; (b) a ledge 62 protruding exteriorly from a lower part of the interior flange 40; (c) a hook 64 formed interiorly on an upper part of the interior flange 40; (d) two ridges 66 and 68, much shorter than the ledge 62, formed exteriorly on the interior flange 40, one on the top end of the flange and the other slightly below it; and (e) a lip 70 on the top end of the exterior flange 38 having an undercut groove 72 defined therein.

With reference back to FIG. 2 it will be noted that an attachment 74 is mounted on the web 36 of the sill 18 and between its exterior and intermediate flanges 38 and 42. Among the purposes of this attachment 74 is to support the paneling 26 thereon. The attachment 74 can also be an extrusion of the same material as that of the sill 18.

Figure 4:
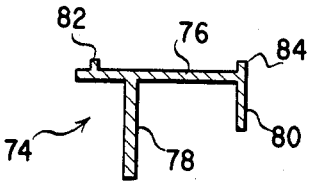
FIG. 4 is a cross sectional view of an attachment combined with the sill as shown in FIG. 2 to make up the bottom framing of the window assembly.

As illustrated by itself in FIG. 4, the attachment 74 is approximately in the shape of an inverted U, integrally comprising a horizontal web 76 and exterior and interior flanges 78 and 80 depending therefrom. While the interior flange 80 is located on the interior end of the web 76, the exterior flange 78 is displaced some distance interiorly from the exterior end of the web. A pair of spaced apart ridges 82 and 84 are formed on the top surface of the web 76.

As will be understood by referring again to FIG. 2, the attachment 74 with its web 76 and exterior flange 78 coacts with the web 36 and exterior flange 38 of the sill 18 to define a water chamber 86 immediately over the drain holes 44. The water chamber 86 accommodates, approximately to its full capacity, a mass of absorbent material 88 such as sponge or felt. The paneling 26 is mounted on the web 76 of the attachment 74 via a setting block 90 of any known or suitable material. Mounted between the pair of ridges 82 and 84 on the web 76, the setting block 90 is thereby restrained from lateral displacement.

FIG. 2 further indicates that a bead 92 is mounted on the web 36 of the sill 18 and between its exterior and intermediate flanges 40 and 42.

Figure 5:
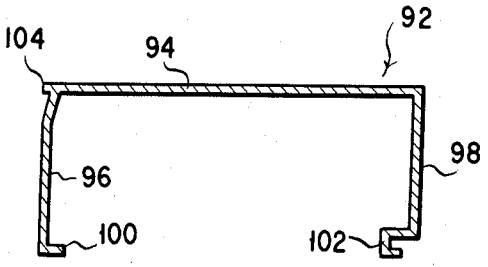
FIG. 5 is a cross sectional view of a bead also combined with the sill as shown in FIG. 2 to make up the bottom framing of the window assembly.

FIG. 5 better illustrates the configuration of the bead 92. Also in the form of an extrusion of the same material as that of the sill 18 and attachament 74, the bead 92 is generally in the shape of an inverted U, comprising a horizontal web 94 and exterior and interior flanges 96 and 98 extending vertically downwardly from the exterior and interior ends, respectively, of the web 94. The exterior flange 96 has a ledge 100 bent interiorly from its bottom end for mating engagement with the hook 60, FIG. 3, on the web 36 of the sill 18. The interior flange 98 has a hook 102 on its bottom end for mating engagement with the ledge 62 on the interior flange 40 of the sill 18. The bead 92 further includes a ridge 104 protruding exteriorly from the web 94 beyond the exterior flange 96.

A reference back, once again, to FIG. 2 will reveal that the bead 92 is taller than the intermediate flange 42 of the sill 18. Thus, between the bead 92 and the interior panel 30 and over the intermediate flange 42, there is mounted a "dry" interior sealing strip 106 which preferably takes the form of an extrusion of relatively soft polyvinyl chloride or the like, complete with a groove for engagement with the ridge 104 of the bead 92. The interior sealing strip 106 watertightly closes the space 108 bounded by the web 36 and intermediate flange 42 of the sill 18 and the exterior flange 96 of the bead 92, thereby preventing the intrusion of any water interiorly beyond the intermediate flange 42.

An exterior sealing strip 110 is mounted between the exterior panel 28 and the grooved lip 70 on the exterior flange 38 of the sill 18. Also in the form of an extrusion of relatively soft polyvinyl chloride or like material, the exterior sealing strip 110 has a portion 112 snugly engaged in the undercut groove 72 in the lip 70. With this portion 112 engaged in the groove 72, the exterior sealing strip 110 is to be mounted in place prior to the installation of the paneling 26, as will be later explained in more detail. The interior sealing strip 106, on the other hand, is to be mounted in place after the installation of the paneling 26.

At 114 in FIG. 2 is shown a stool which also can be an extrusion of the same material as the sill 18. Disposed immediately interiorly of the bead 92 and flush with its web 94, the stool 114 has a depending rim 116 extending along its exterior edge for resting on the top end 117 of the interior flange 40 of the sill 18. A hook 118 is formed on the underside of the stool 114 and interiorly of the rim 116 for engagement with the hook 64 on the interior flange 40 of the sill 18.

METHOD OF INSTALLATION

What follows is a discussion of the procedure through which the foregoing windowsill construction may be watertightly mounted on the building foundation 32. The window base 34 may first be mounted on the foundation 32 by inserting into and through its unshown holes the anchor bolts, also not shown, that have been planted in the foundation at suitable distances and with a suitable relative placement. It is understood that the anchor bolts are of such length that their threaded ends protrude upwaardly of the window base 34. Nuts may be tightened on these protruding ends of the anchor bolts for immovably retaining the window base 34 on the foundation 32.

Then the sill 18 may be placed on the window base 34, with its depressed surface 48 and interior and exterior legs 50 and 52 bearing directly against the window base. The ledge 54 of the exterior leg 52 and the ledge 120 of the interior leg 50 should at least partly protrude exteriorly and interiorly, respectively, of the window base 34, as shown in FIG. 2. The sill 18 should be secured to the window base 34 as by wood screws, not shown, of stainless steel or the like.

Next comes the caulking of the spaces between the foundation 32 and the interior and exterior legs 50 and 52. With, or without, use of backups 122, a wet sealing compound may be filled in the required spaces for making them impervious to both water and air, as indicated by the numerals 124 and 126. The sealing compound may be of synthetic resin material such as that composed primarily of polyvinyl chloride or silicone.

It should be appreciated that, in thus caulking the space between the foundation 32 and the ledge 54 of the exterior leg 52, the overlying drain holes 44 are guarded by the ledge 54 against accidental clogging with the caulking 124. Moreover, since the ledge 54 is spaced from the drain holes 44, the caulking operation will be much easier than if the entire space between the foundation 32 and the web 36 of the sill 18 is caulked as in the prior art. The line of the caulking 124 can be continuous as it has no possibility of blocking the drain holes 44.

With the caulking operation completed, the absorbent material 88 may be placed over the drain holes 44, and the attachment 74 may be mounted between the exterior flange 38 and intermediate flange 42 of the sill 18, with the flanges 78 and 80 of the attachment held against the web 36 of the sill. Now the absorbent material 88 is confined in the water chamber 86 defined by the sill 18 and attachment 74.

Then the setting block 90 may be mounted between the pair of ridges 82 and 84 on the web 76 of the attachment 74. Then, after mounting the external sealing strip 110 in place by engaging its portion 112 in the undercut groove 72 in the external flange 38 of the sill 18, the paneling 26 may be installed on the setting block 90 from the interior side of enclosing wall 14. The exterior sealing strip 110 will then become held fast against the exterior panel 28 for saling the gap between this exterior panel and the external flange 38 of the sill 18.

The next step is the installation of the bead 94. This bead may be placed on the sill web 36 and between its interior flange 40 and intermediate flange 42. The hook 102 on the interior flange 98 of the bead 92 may first be engaged with the ledge 62 on the internal flange 40 of the sill 18, followed by the engagement of the ledge 100 on the exterior flange 96 of the bead 92 with the hook 60 on the web 36 of the sill.

Then the interior sealing strip 106 may be driven in between the interior panel 30 and the bead 92 until the sealing strip comes into sealing engagement with the top end portion of the intermediate flange 42 of the sill 18. The preformed groove in the interior sealing strip 106 will then engage the ridge 104 of the bead 92. Thus the interior sealing strip 106 will make firm sealing contact with all of the interior panel 30, the intermediate flange 42 of the sill 18, and the web 94 and exterior flange 96 of the bead 92.

Finally, the stool 114 may be mounted by placing its rim 116 on the top end 117 of the interior flange 40 of the sill 18 and by engaging its hook 118 with the hook 64 on the interior flange 40. So mounted, the stool 14 will be closely held against the bead 92 in coplanar relation to its web 94. Now has been completed the installation of the waterproof windowsill means in accordance with the invention.

In the fixed sash window 10 constructed and installed as in the foregoing, the drain shield 58 functions to shield the drain holes 44 against the intrusion of the water that has come falling down the exterior panel 28 and hte exterior flange 38 of the sill 18. Although the exterior sealing strip 110 closes the gap between the exterior panel 28 and the external flange 38 of the sill 18, there may still be some water finding its way down through minute interstices between the sealing strip 110 and the exterior panel 28. All such water will be taken up by the absorbent material 88 in the water chamber 86 and will be infallibly drained through the drain holes 44. Furthermore, as a pronounced feature of the invention, these drain holes 44 are not to be clogged by the caulking 124 because of the provision of the ledge 54 on the exterior leg 52 of the sill 18, as has been explained in connection with the application of the caulking 124. With all these advantages of this invention combined, the window assembly 10 will remain extremely waterproof throughout its lifetime.

Although the improved watertight windowsill construction of this invention has been shown and described as applied to a fixed sash window, it is not desired to limit the invention to this specific application. A variety of modifications or alterations of of the above disclosed embodiment may be devised to conform to design preferences or to the specific requirements of each intended application of the windowsill construction without in any way departing from the scope of the invention.

What is claimed is:

1. A fixed sash window assembly for installation in an opening in an enclosing wall of a building, the opening being defined in part by a foundation of the building having a window base immovably mounted thereon, the fixed sash window assembly comprising:

(a) panel means;

(b) frame means of generally rectangular arrangement, to be installed in the opening in the enclosing wall of the building, for receiving and holding the panel means;

(c) a sill included in the frame means and integrally comprising:

(1) a web generally disposed horizontally and having an exterior end and an interior end;

(2) an exterior flange extending upwardly from the exterior end of the web;

(3) there being a series of spaced apart drain holes defined in the web and disposed interiorly of, and along, the exterior flange;

(4) a drain shield extending downwardly from the web and disposed exteriorly of the drain holes in the web for shielding the drain holes against the backflow of water therethrough; and (5) leg means depending from the web to be mounted directly on the window base and including an exterior leg having horizontal ledge extending exteriorly beyond the window base into underlying relation to the drain holes in the web at a distance therefrom, so that a space thus created between the horizontal ledge of the exterior leg of the leg means and the foundation of the building can be caulked by filling a sealing compound in the form of continuous strip without the possibility of blocking the drain holes in the web:

(d) an attachment mounted on the web of the sill, and disposed interiorly of the exterior flange thereof, for supporting the panel means thereon, the attachment further coacting with the sill to define a water chamber over the drain holes in the web of the sill, the water chamber being in communication with a gap between the panel means and the exterior flange of the sill; and (e) an exterior sealing strip mounted between the panel means and the exterior flange of the sill for watertightly sealing the gap therebetween.

2. The fixed sash window assembly as recited in claim 1, wherein the drain shield is in coplanar relation to the exterior flange of the sill.

3. The fixed sash window assembly as recited in claim 1, wherein the water chamber is adapted to be filled with a mass of absorbent material for absorbing the water that may come flowing in through the sealed gap between the panel means and the exterior flange of the sill, in order to ensure the drainage of the water through the drain holes in the web.

4. The fixed sash window assembly as recited in claim 1, wherein the sill of the frame means is further formed to include an intermediate flange extending upwardly from the web and disposed intermediate the exterior and interior ends thereof, and wherein the attachement is disposed between the exterior and intermediate flanges of the web.

5. The fixed sash window assembly as recited in claim 4, wherein the sill of the frame means is further formed to include an interior flange extending upwardly from the interior end of the web, and wherein the window assembly further comprises:

(a) a bead mounted between the intermediate and interior flanges of the web and partly extending upwardly beyond the intermediate flange; and (b) an interior sealing strip for watertightly sealing a gap between the panel means and the intermediate flange and a gap between the intermediate flange and the bead.

* * * * *